US008133061B1

(12) United States Patent
Ayers, Sr. et al.

(10) Patent No.: US 8,133,061 B1
(45) Date of Patent: Mar. 13, 2012

(54) REMOVABLE AND REPLACEABLE DUAL-SIDED CONNECTOR PIN INTERPOSER

(75) Inventors: Robert L. Ayers, Sr., Durham, NC (US); Tu T. Dang, Cary, NC (US); Michael C. Elles, Apex, NC (US); Ketan B. Patel, Raleigh, NC (US); James S. Womble, Hillsborough, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/955,883

(22) Filed: Nov. 29, 2010

(51) Int. Cl.
*H01R 12/00* (2006.01)

(52) U.S. Cl. ..... 439/66

(58) Field of Classification Search ..... 439/66, 439/886–888, 700, 71; 324/754
See application file for complete search history.

(56) References Cited

U.S. PATENT DOCUMENTS 5,061,192 A * 10/1991 Chapin et al. ..... 439/66
5,297,967 A * 3/1994 Baumberger et al. ..... 439/66
6,015,301 A 1/2000 Brodsky et al.
6,538,214 B2 * 3/2003 Khandros ..... 174/267
2004/0166702 A1 * 8/2004 Higashi ..... 439/66
2008/0265922 A1 * 10/2008 Eldridge et al. ..... 324/754
2009/0189624 A1 * 7/2009 Oh et al. ..... 324/754

OTHER PUBLICATIONS

"Method to Prevent Damage and Enhance Design Performance of Logic Analyzer Interface Probes for mPGA-Packaged Micro-Processors", IP.com, Mar. 31, 2004, 4 pages.
"Method for a modular stamped-contact socket", IP.com, Mar. 9, 2006, 5 pages.

* cited by examiner

*Primary Examiner* — Tulsidas C Patel
*Assistant Examiner* — Harshad Patel
(74) *Attorney, Agent, or Firm* — Mark C. Vallone; Amy J. Pattillo

(57) ABSTRACT

A dual-sided connector pin interposer includes a substrate comprising a first side opposite a second side. The interposer includes a first plurality of flexible pins protruding from the first side of the substrate. The first plurality of flexible pins is positioned for installation in a first plurality of pad connectors of the pinless socket. The interposer includes a second plurality of flexible pins protruding from the second side of the substrate. The second plurality of flexible pins is positioned for installation in a second plurality of pad connectors of the pinless integrated circuit component. The first plurality of flexible pins are electrically connected to the second plurality of flexible pins through the substrate to provide electrical contact points between the pinless socket and the pinless integrated circuit component when the interposer is installed.

7 Claims, 3 Drawing Sheets

REMOVABLE AND REPLACEABLE DUAL-SIDED CONNECTOR PIN INTERPOSER

BACKGROUND

1. Technical Field

The embodiment of the invention relates generally to an interposer and particularly to a removable and replaceable dual-sided connector pin interposer for connecting a pinless socket on a board and a pinless integrated circuit component.

2. Description of Related Art

In many cases, one manufacturer will produce a large scale integration (LSI) integrated circuit (IC), such as a Central Processing Unit (CPU), to be installed onto a socket on a board, such as a CPU board or system board, of another manufacturer. Some IC package designs include an IC package containing connector pins designed to be inserted into pad connectors on the socket, however, a limitation of IC packages including pins is that if any damage occurs to a pin on the IC package during installation, the IC package becomes unusable because the pins of the IC package will not reliably align with the pad connectors of the socket to establish electrical connections.

IC package manufacturers also design IC packages that implement a pinless IC, and require the CPU board or system board manufacturers to manufacture a mounting socket on a board that includes connector pins, such that bent pin damage occurs at the board level, rather than the IC package level. IC packages with bent pins are expensive to replace, but boards are also expensive to replace, particularly once installed in a customer environment. With even one bent pin on a socket, the board becomes unusable and must be replaced. As the number of connector pins on a board increases, to provide a mounting interface for IC packages with increasing numbers of pad connectors, the probability of damage to a pin at the board level increases.

BRIEF SUMMARY

According to one embodiment, an interposer comprises a substrate, a first plurality of flexible pins, and a second plurality of flexible pins. The substrate comprises a first side opposite a second side. The first plurality of flexible pins protrude from the first side of the substrate and are for installing in a first plurality of pad connectors of a pinless socket. The second plurality of flexible pins protrude from the second side of the substrate and are for installing in a second plurality of pad connectors of a pinless integrated circuit component. The interposer further includes a first presence pin specified from among the first plurality of flexible pins and set to ground opposite a second pin from among the second plurality of flexible pins not specified for an electrical connection. The first presence pin is specified to align with a particular pad connector from among the first plurality of pad connectors comprising an input port of the pinless socket. The first plurality of flexible pins except the first presence pin are electrically connected to the second plurality of flexible pins through the substrate to provide a plurality of electrical contact points between the pinless socket and the pinless integrated circuit component.

Another embodiment of the invention provides a system comprising a pinless socket comprising a first plurality of pad connectors. The system also comprises a pinless integrated circuit component comprising a second plurality of pad connectors. The system also comprises an interposer comprising a substrate comprising a first side opposite a second side. The interposer also comprises a first plurality of flexible pins protruding from the first side of the substrate, the first plurality of flexible pins for installing in the first plurality of pad connectors of the pinless socket. The interposer also comprises a second plurality of flexible pins protruding from the second side of the substrate, the second plurality of flexible pins for installing in the second plurality of pad connectors of the pinless integrated circuit component. The interposer also includes a first presence pin specified from among the first plurality of flexible pins and set to ground opposite a second pin from among the second plurality of flexible pins not specified for an electrical connection. The first presence pin is specified to align with a particular pad connector from among the first plurality of pad connectors including an input port of the pinless socket. The first plurality of flexible pins except the first presence pin are electrically connected to the second plurality of flexible pins through the substrate to provide electrical contact points between the pinless socket and the pinless integrated circuit component. The first plurality of flexible pins are installed in the first plurality of pad connectors of the pinless socket. The pinless socket also includes a pull up resistor installed on the input port and operative to set a signal for a presence bit to a first logical bit if the interposer is properly installed. The system also includes an input/output controller for reading the signal from the input port. The input/output controller is operative to output a signal indicating a proper installation of the interposer if the presence bit is set to the first logical bit in the signal read from the input port. The input/output controller is operative to output a signal indicating a failed installation of the interposer if the presence bit is set to a second logical bit in the signal read from the input port.

BRIEF DESCRIPTION OF THE SEVERAL VIEWS OF THE DRAWINGS

The novel features believed characteristic of one or more embodiments of the invention are set forth in the appended claims. The one or more embodiments of the invention itself however, will best be understood by reference to the following detailed description of an illustrative embodiment when read in conjunction with the accompanying drawings, wherein:

DETAILED DESCRIPTION

In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

In addition, in the following description, for purposes of explanation, numerous systems are described. It is important to note, and it will be apparent to one skilled in the art, that the present invention may execute in a variety of systems, including a variety of computer systems and electronic devices operating any number of different types of operating systems.

Figure 1:
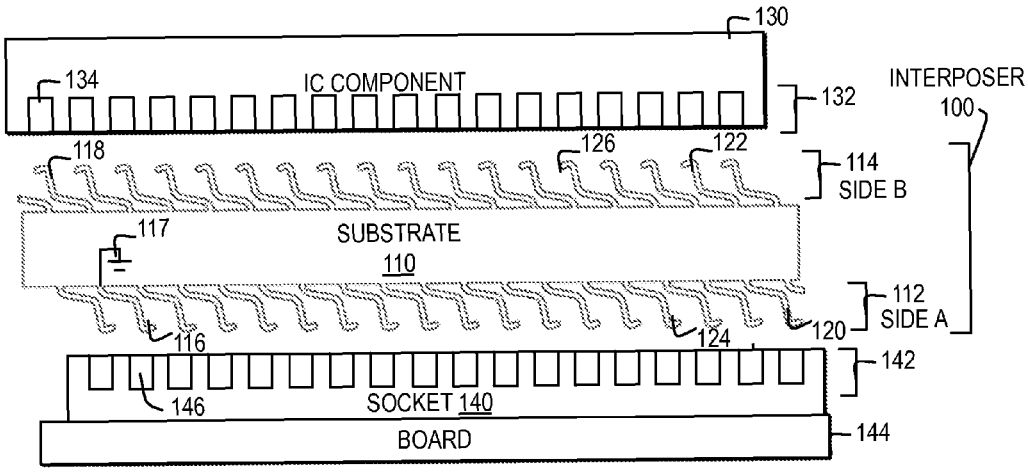
FIG. 1 illustrates a side view of a replaceable dual-sided connector pin interposer for connecting an IC component to a socket on a board.

FIG. 1 illustrates a side view of a replaceable dual-sided connector pin interposer for connecting an IC component to a socket on a board. In the example, interposer 100 includes substrate 110 with first set of flexible pins 112 protruding from substrate 110 on side A and second set of flexible pins 114 protruding from substrate 110 on side B. Flexible pins 112 on side A are shaped and positioned for connecting to pad connectors 142 of pinless socket 140 on board 144. Flexible pins 114 on side B are shaped and positioned for connecting to pad connectors 132 of a pinless IC component 130. Pad connectors 142 and pad connectors 132 are shaped and positioned to optimally connect with flexible pins 112 and flexible pins 114 to establish and maintain electrical connections. In one example, IC component 130 represents a large scale integrated circuit, such as a CPU. In addition, in one example, socket 140 on board 144 represents a CPU socket on a system board.

By connecting pinless IC component 130 to pinless socket 140 on board 144 through interposer 100, pin damage is limited to interposer 100. In the event of damage to a pin on interposer 100, only interposer 100 needs to be replaced as there are no pins on socket 140 or IC component 132 to damage. Replacement of interposer 100 is more economical and efficient than replacement of socket 140 or IC component 130.

In one example, substrate 110 is a printed circuit board used to mechanically support and electrically connect flexible pins 112 and flexible pins 114 using conductive pathways, tracks or signal traces laminated onto a non-conductive substrate. In one example, substrate 110 is manufactured using a material that will not bow so that interposer 100 provides even contact across all of pad connectors 142 of socket 140 on board 144 and all of pad connectors 132 of IC component 132 and maintains signal integrity on a high speed bus. In addition, substrate 110 and flexible pins 112 and 114 are manufactured using material that conforms to design guidelines for both the manufacturer of socket 140 on board 144 to be connected to side A and the manufacturer of IC component 132 to be connected to side B. For example, design guidelines may include guidelines for one more types of manufacturing specifications including, but not limited to, laminate types, grade specifications, such as FR-4, FR-1, CEM-1 or CEM-3, coating types, such as solder mask, conductive pastes, such as via fill paste, and flexible pin plating.

Flexible pins 112 and flexible pins 114 provide electrical contact points between pinless socket 140 and IC component 130. In one example, flexible pins 112 and flexible pins 114 include one or more signal connector pins, such as signal connector pin 120 on side A and signal connector pin 122 on side B, for connecting a signal path points between IC component 130 and socket 140. In addition, flexible pins 112 and flexible pins 114 include one or more power and ground pins, such as power pin 124 on side A and power pin 126 on side B, for connecting power and ground contact points between IC component 130 and socket 140, to electrically connect IC component 130 to board 144. While one embodiment of interposer 100 illustrates both signal connector pins and power and ground pins, in other embodiments of interposer 100, additional or alternate types of pins may be implemented.

In the example of FIG. 1, interposer 100 includes at least one installation pin 116 on side A. Installation pin 116 is positioned on side A of substrate 110 as a guide pin to enable a system to guide the installation of interposer 100 on socket 140, and as a presence pin to detect whether a correct interposer is used and whether interposer 100 is installed properly, when installed. As illustrated, installation pin 116 is positioned to align with and electrically connect to pad connector 146 of socket 140 when interposer 100 is properly installed and locked into socket 142, when interposer 100 is the correct interposer for installation to socket 140.

In particular, to detect whether interposer 100 is properly installed, in the example, installation pin 116 on side A is positioned opposite to pin 118 on side B of substrate 110, where pin 118 is a pin that does not provide any function, and in particular does not provide an electrical connection to IC component 130. In the example, the position of installation pin 116 is selected opposite of a pin on side B of interposer 100 that does not provide any function so that installation pin 116 is selected to not interfere with the pins on side B of interposer 100 that provide electrical connections to IC component 130. In addition, in the example, installation pin 116 is grounded on substrate 110, as illustrated at reference numeral 117. By grounding installation pin 116, when interposer 100 is installed, a system input/output (I/O) controller will read either a '0' or '1' bit from the signal on installation pin 116, and determine from the bit setting whether interposer 100 is installed correctly. In other embodiments, interposer 100 may include additional or alternate installation pins. In addition, in other embodiments, interposer 100 may include one or more installation pins, as guide pins only, for providing proper alignment of interposer 100 during installation, and one or more separate installation pins, as presence pins only, for providing a signal to the I/O controller indicating whether interposer 100 is properly installed. In addition, in the example pad connector 146 is illustrated as the pad connector for aligning with installation 116, where pad connector 146 may function as an input only port or an input/output port, such as a general purpose I/O port, for installation pin 116 as a presence pin and may function as a guide space for installation pin 116 as a guide pin.

In addition, to provide additional protection to interposer 100 and socket 140 during installation, each of installation pin 116 and corresponding pad connector 146, functioning as a guide space, are set at a depth that limits the depth to which flexible pins 112 connect with pad connectors 142, to prevent interposer 100 from damaging socket 140 during installation and to reduce the frequency of bent pin damage to flexible pins 112 of interposer 100 during installation. In addition, each of installation pin 116 and corresponding pad connector 146 may be positioned to accommodate for the rotation of socket 140 on board 144, the thickness of board 144, one or more clearance requirements of other components adjacent to socket 140 on board 144, and other factors that affect the proper alignment of interposer 110 when connected with socket 140, to prevent interposer 100 from damaging socket 140 or other components on board 144, during installation and to reduce the frequency of bent pin damage to flexible pins 112 of interposer 100 during installation.

Figure 2:
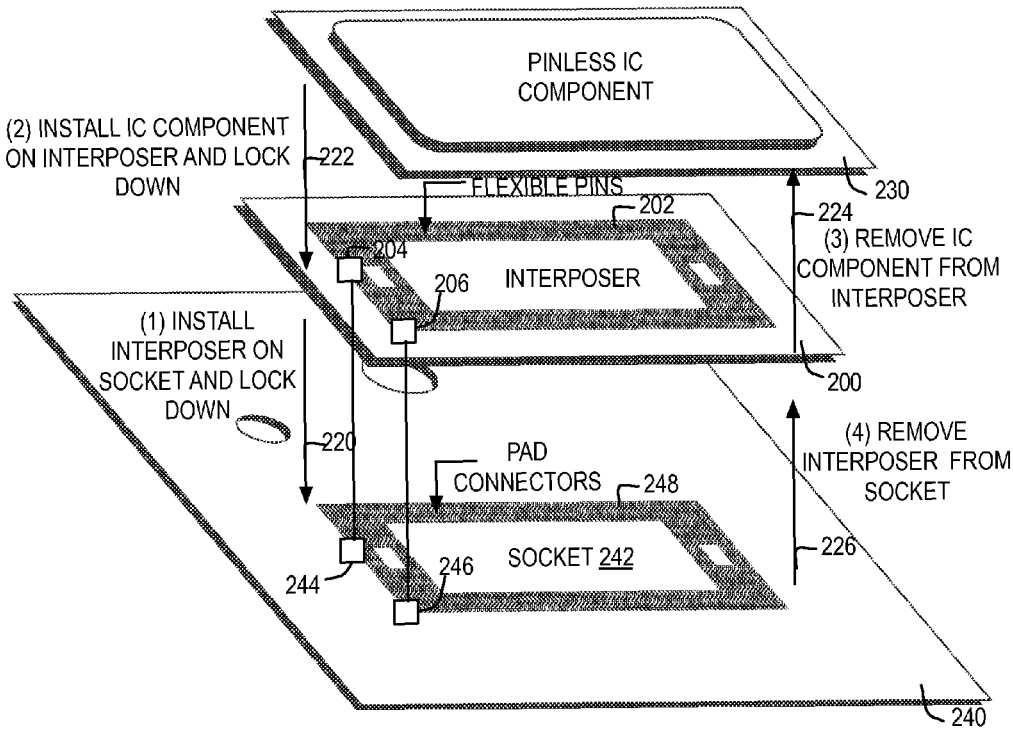
FIG. 2 illustrates a top view of a pinless socket on a board, a dual-sided pinned connection interposer, and a pinless IC component.

FIG. 2 illustrates a top view of a pinless socket on a board, a dual-sided pinned connection interposer, and a pinless IC component. In the example, interposer 200 is installed and locked down on pad connectors 248 of pinless socket 242 on board 240, as illustrated at reference numeral 220. Although not depicted, the underside of interposer 200 includes multiple flexible pins, as illustrated by flexible pins 112 of interposer 100 in FIG. 1. In addition, pinless IC component 230 is installed and locked down on flexible pins 202 of interposer 200, as illustrated at reference numeral 222. Although not depicted, the underside of IC component 230 includes multiple pad connectors, as illustrated by pad connectors 132 of IC component 130 in FIG. 1. In addition, a heat sink or thermal material may be installed on IC component 230 and other materials may be installed on IC component 230 or board 240.

When installing interposer 200 on socket 242 and IC component 230 on interposer 200, one or more installation pins functioning as guide pins on interposer 200 and one or more pad connectors functioning as guide spaces on socket 242 are positioned to aid in the proper alignment of components during installation. In the example, guide space 244 on socket 242 aligns with a guide pin at a location 204 on the underside of interposer 200. The position of guide pins and guide spaces as well as the number of positions of guide pins and guide space are selected to provide for proper alignment of interposer 200 onto socket 242 during installation.

When installing interposer 200 on socket 242, one or more installation pins functioning as presence pins on interposer 200 and one or more input ports on socket 242 are selected to test whether a signal connects properly to socket 242 through interposer 200. In the example, if interposer 200 is properly installed on socket 242, then a signal will be detected running from an input port 246, through a presence pin on the underside of interposer 200 at connection point 206.

Interposer 200 may also be removed and replaced. For example, interposer 200 may be removed and replaced if one of the flexible pins on either side of interposer 200 is damaged. In the example, IC component 230 is removed from interposer 200, as illustrated at reference numeral 224, and interposer 200 is removed from socket 242, as illustrated at reference numeral 226.

Figure 3:
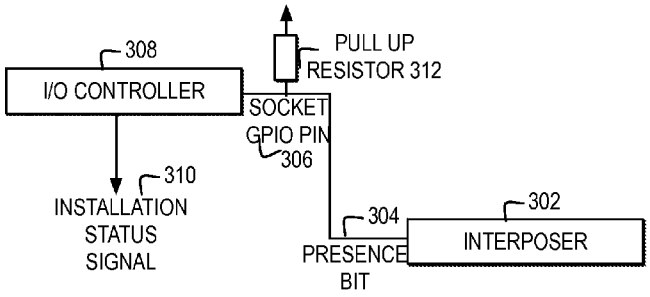
FIG. 3 illustrates an example of one embodiment of an I/O controller for detecting whether an interposer is properly installed.

FIG. 3 illustrates an example of one embodiment of an I/O controller for detecting whether an interposer is properly installed. In the example, I/O controller 308 reads a signal from a general purposes I/O (GPIO) pin of a socket, as illustrated at reference numeral 306. The GPIO pin of the socket is designed to connect with a presence pin of interposer 302 and, through the voltage pull of pull-up resistor 312, to detect a presence bit 304 of either a '0' or a '1'. In one example, where the pin associated with presence bit 304 is grounded as illustrated at reference numeral 117 for installation pin 116 in FIG. 1, presence bit 304 is set to a '0' bit when interposer 302 is properly installed on the socket and pulled to a '1' bit when interposer 302 is not properly installed on the socket. If I/O controller 308 detects that presence bit 304 is set to a '0' bit, I/O controller 308 outputs a signal indicating that interposer 302 is properly installed. In one example, I/O controller 308 outputs an installation status signal 310 indicating whether interposer 302 is properly installed, based on the value of presence bit 304. By outputting installation status signal 310 from I/O controller 308, an operating system or other software component may read installation status signal 310 from I/O controller 308 and update an installation status of interposer 302 within a graphical user interface output from a computer system. In addition, by outputting installation status signal 310 from I/O controller 308, installation status signal 310 may control an LED or other output interface that indicates whether interposer 302 is properly installed.

Figure 4:
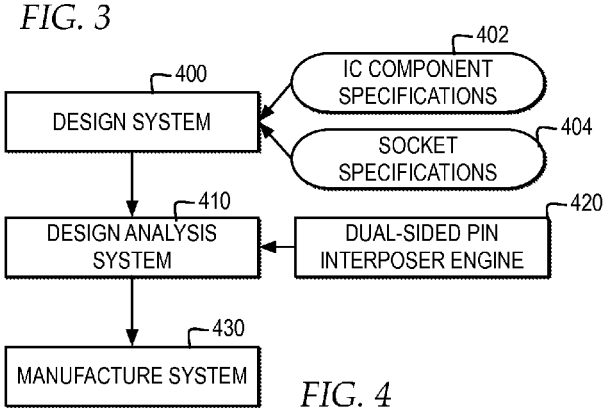
FIG. 4 illustrates a block diagram of one embodiment of a system for generating a dual-sided connector pin interposer.

FIG. 4 illustrates a block diagram of one embodiment of a system for generating a dual-sided connector pin interposer. As illustrated in FIG. 4, the system includes design system 400 coupled to design analysis system 410. Also coupled to design analysis system 410 is dual-sided pin interposer engine 420 and manufacture system 430. Design system 400 provides a design for a pinless IC component and a pinless socket on a board based on one or more specifications for an IC component and a socket on a board received from one or more manufacturers, such as IC component specifications 402 and socket specifications 404.

Design analysis system 410 analyzes the design produced by design system 400 and interfaces with dual-sided pin interposer engine 420, which specifies the design for a dual-sided connector pin interposer to connect the pinless IC component to the pinless socket. In specifying the design for the dual-sided connector pin interposer, dual-sided pin interposer engine 420 applies one or more requirements within IC component specification 402 and socket specification 404 to specify one or more manufacturing characteristics of the flexible pins of the interposer and to specify one or more manufacturing characteristics of a substrate from which the flexible pins extend.

In one example, dual-sided pin interposer engine 420 identifies a number of flexible connector pins to position on a substrate to design the dual-sided connector pin interposer for connecting the pinless IC component to the pinless socket on a board. In one example, the pinless IC component is specifically manufactured for connection with the pinless socket on the board, and dual-sided pin interposer engine 420 further specifies the size, shape, depth and composition of connector pins to interpose between the pinless IC component and the pinless socket to meet connectivity requirements specified in IC component specifications 402 and socket specifications 404. In another example, the pinless IC component is not specifically manufactured for connection with the pinless socket on the board, and design analysis system 410 further specifies a number of pins, function of pins, position of pins, and shape of the pins on an interposer to make the pinless IC component compatible with the pinless socket.

In addition, dual-sided pin interposer engine 420 specifies layers of the substrate, such as a PC board, for the interposer to connect the identified connector pins for providing electrical connections for signal connector pins and power and ground pins. In specifying the layers of the substrate, dual-sided pin interposer engine 420 specifies one or more characteristics of the substrate according to connectivity and manufacturing requirements specified in IC component specifications 402 and socket specifications 404. In addition, in specifying the layers of the substrate, dual-sided pin interposer engine 420 specifies one or more characteristics of the substrate to design a substrate to bear the required flexible connector pins, that when manufactured, will not bow.

In addition, in specifying the number and position of flexible pins, dual-sided pin interposer engine 420 identifies one or more connector pins to position on the substrate as installation pins that function as guide pins, where the depth, position, and composition of the guide pins are selected to protect the socket on the board from damage from the interposer during installation, and to provide a guide for proper alignment of the interposer with the socket on the board during installation for reducing damage to pins of the interposer. Design analysis system 410 may also adjust the design of the socket on the board to add or reposition guide spaces with which the guide pins of the interposer will align.

In addition, in specifying the number and position of flexible pins, dual-sided pin interposer engine 420 identifies one or more sets of connector pins to position on the substrate as installation pins that function as presence pins, where the presence pins are positioned to connect with a pad connector that functions as an input port of the socket on the board, such that a setting of a bit on the input port indicates whether a signal flows through the interposer, indicating the interposer is properly installed. Design analysis system 410 may also adjust the design of the socket on the board to add or reposition input ports with which the presence pins of the interposer will connect.

Manufacture system 430 fabricates the dual-sided pin connector interposer as specified by design analysis system 410 to install on the socket and to install the IC component on the dual-sided pin connector interposer. In addition, manufacture system 430 may fabricate one or more of the socket on the board and the IC component, according to designs as modified by design analysis system 410.

Figure 5:
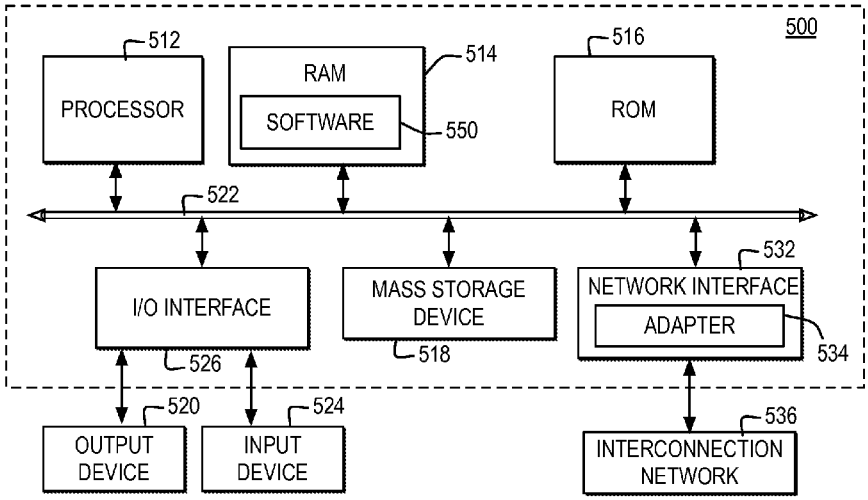
FIG. 5 illustrates one example of a computer system in which an interposer may be placed, a system according to FIG. 4 may be implemented and processes and programs according to FIGS. 6 and 7 may be performed.
Figure 6:
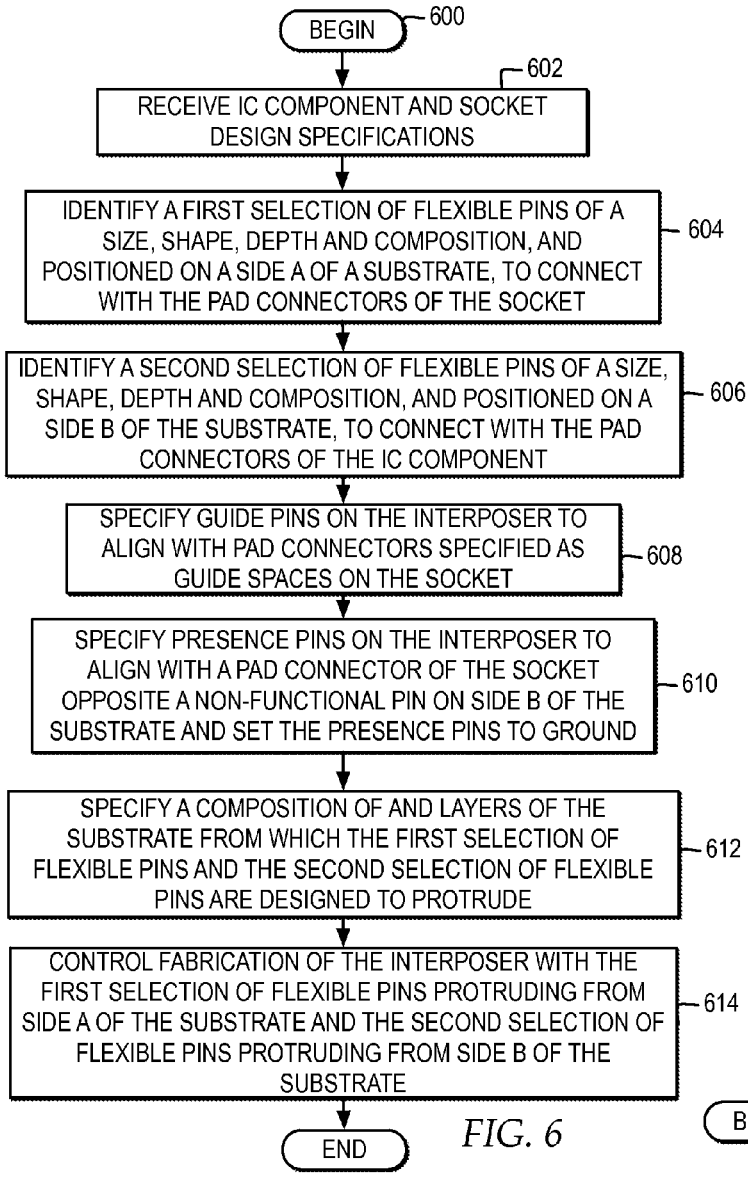
FIG. 6 illustrates a high level logic flowchart for specifying an interposer for connecting an IC component to a socket on a board.
Figure 7:
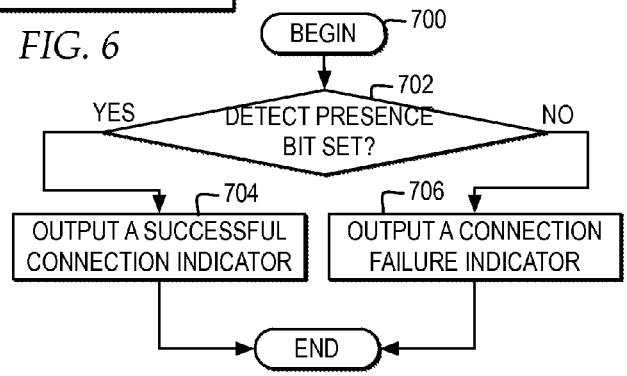
FIG. 7 illustrates a high level logic flowchart for monitoring for proper installation of an interposer.

FIG. 5 illustrates one example of a computer system in which an interposer may be placed, a system according to FIG. 4 may be implemented and processes and programs according to FIGS. 6 and 7 may be performed. The present invention may be performed in a variety of systems and combinations of systems, made up of functional components, such as the functional components described with reference to computer system 500 and may be communicatively connected to a network, such interconnection network 536.

Computer system 500 includes a bus 522 or other communication device for communicating information within computer system 500, and at least one hardware processing device, such as processor 512, coupled to bus 522 for processing information. Bus 522 preferably includes low-latency and higher latency paths that are connected by bridges and adapters and controlled within computer system 500 by multiple bus controllers. When implemented as a server or node, computer system 500 may include multiple processors designed to improve network servicing power. Where multiple processors share bus 522, additional controllers (not depicted) for managing bus access and locks may be implemented.

Processor 512 may be at least one general-purpose processor such as IBM® PowerPC® (IBM and PowerPC are registered trademarks of International Business Machines Corporation) processor that, during normal operation, processes data under the control of software 550, which may include at least one of application software, an operating system, middleware, and other code and computer executable programs accessible from a dynamic storage device such as random access memory (RAM) 514, a static storage device such as Read Only Memory (ROM) 516, a data storage device, such as mass storage device 518, or other data storage medium. Software 550 may include, but is not limited to, code, applications, protocols, interfaces, and processes for controlling one or more systems within a network including, but not limited to, an adapter, a switch, a cluster system, and a grid environment.

In one embodiment, the operations performed by processor 512 may control the operations of flowchart of FIGS. 6 and 7 and other operations described herein. Operations performed by processor 512 may be requested by software 550 or other code or the steps of one embodiment of the invention might be performed by specific hardware components that contain hardwired logic for performing the steps, or by any combination of programmed computer components and custom hardware components.

Those of ordinary skill in the art will appreciate that aspects of one embodiment of the invention may be embodied as a system, method or computer program product. Accordingly, aspects of one embodiment of the invention may take the form of an entirely hardware embodiment, an entirely software embodiment (including firmware, resident software, microcode, etc.) or an embodiment containing software and hardware aspects that may all generally be referred to herein as "circuit," "module," or "system." Furthermore, aspects of one embodiment of the invention may take the form of a computer program product embodied in one or more tangible computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, device, or any suitable combination of the foregoing. More specific examples (a non-exhaustive list) of the computer readable storage medium would include the following: an electrical connection having one or more wires, a portable computer diskette, a hard disk, such as mass storage device 518, a random access memory (RAM), such as RAM 514, a read-only memory (ROM) 516, an erasable programmable read-only memory (EPROM or Flash memory), an optical fiber, a portable compact disc read-only memory (CDROM), an optical storage device, a magnetic storage device, or any suitable combination of the foregoing. In the context of this document, a computer readable storage medium may be any tangible medium that can contain or store a program for use by or in connection with an instruction executing system, apparatus, or device.

A computer readable signal medium may include a propagated data signal with the computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction executable system, apparatus, or device.

Program code embodied on a computer readable medium may be transmitted using any appropriate medium, including but not limited to, wireless, wireline, optical fiber cable, radio frequency (RF), etc., or any suitable combination of the foregoing.

Computer program code for carrying out operations of on embodiment of the invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, such as computer system 500, partly on the user's computer, as a stand-alone software package, partly on the user's computer and partly on a remote computer or entirely on the remote computer or server. In the latter scenario, the remote computer may be connected to the user's computer through any type of network, such as interconnection network 536, through a communication interface, such as network interface 532, over a network link that may be connected, for example, to interconnection network 536.

In the example, network interface 532 includes an adapter 534 for connecting computer system 500 to interconnection network 536 through a link. Although not depicted, network interface 532 may include additional software, such as device drivers, additional hardware and other controllers that enable communication. When implemented as a server, computer system 500 may include multiple communication interfaces accessible via multiple peripheral component interconnect (PCI) bus bridges connected to an input/output controller, for example. In this manner, computer system 500 allows connections to multiple clients via multiple separate ports and each port may also support multiple connections to multiple clients.

One embodiment of the invention is described below with reference to flowchart illustrations and/or block diagrams of methods, apparatus (systems) and computer program products according to embodiments of the invention. Those of ordinary skill in the art will appreciate that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer, such as computer system 500, or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer, such as computer system 500, or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Network interface 532, the network link to interconnection network 536, and interconnection network 536 may use electrical, electromagnetic, or optical signals that carry digital data streams. The signals through the various networks and the signals on interconnection network 536, the network link to interconnection network 536, and network interface 532 which carry the digital data to and from computer system 500, may be forms of carrier waves transporting the information.

In addition, computer system 500 may include multiple peripheral components that facilitate input and output. These peripheral components are connected to multiple controllers, adapters, and expansion slots, such as input/output (I/O) interface 526, coupled to one of the multiple levels of bus 522. For example, input device 524 may include, for example, a microphone, a video capture device, an image scanning system, a keyboard, a mouse, or other input peripheral device, communicatively enabled on bus 522 via I/O interface 526 controlling inputs. In addition, for example, output device 520 communicatively enabled on bus 522 via I/O interface 526 for controlling outputs may include, for example, one or more graphical display devices, audio speakers, and tactile detectable output interfaces, but may also include other output interfaces. In alternate embodiments of the present invention, additional or alternate input and output peripheral components may be added.

Those of ordinary skill in the art will appreciate that the hardware depicted in FIG. 5 may vary. Furthermore, those of ordinary skill in the art will appreciate that the depicted example is not meant to imply architectural limitations with respect to the present invention.

FIG. 6 illustrates a high level logic flowchart for specifying an interposer for connecting an IC component to a socket on a board. As illustrated, the process starts at block 600 and thereafter proceeds to block 602. Block 602 illustrates receiving IC component and socket design specifications and requirements. Next, block 604 depicts identifying a first selection of flexible pins of a size, shape, depth, and composition, and positioned on a side A of a substrate, to connect with the pad connectors of the socket. Next, block 606 illustrates identifying a second selection of flexible pins of a size, shape, depth, and composition, and positioned on a side B of the substrate, to connect with the pad connectors of the IC component. Thereafter, block 608 illustrates specifying guide pins on side A of the substrate to align with pad connectors specified as guide spaces on the socket. Next, block 610 depicts positioning presence pins on side A of the substrate to align with a pad connector that functions as an input port of the socket, opposite a non-functional pin of side B of the substrate, and setting the presence pins to ground. Guide pins and presence pins may be specified as separate pins or may be combined into a single pin or set of pins. Thereafter, block 612 illustrates specifying a composition of and layers of the substrate from which the first selection of flexible pins and the second selection of flexible pins are designed to protrude. Next, block 614 depicts controlling fabrication of the interposer with the first selection of flexible pins protruding from a side A of the substrate and the second selection of flexible pins protruding from a side B of the substrate, and the process ends.

FIG. 7 depicts a high level logic flowchart for monitoring for proper installation of an interposer. In the example, the process starts at block 700 and thereafter proceeds to block 702. Block 702 illustrates a determination whether a presence bit detected from an input port designed for alignment with a presence pin is set. If a presence bit is set, then the process passes to block 704. Block 704 depicts outputting a successful connection indicator, and the process ends. At block 702, if the presence bit is not set, then the process passes to block 706. Block 706 depicts outputting a connection failure indicator, and the process ends.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, occur substantially concurrently, or the blocks may sometimes occur in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification specify the presence of stated features, integers, steps, operations, elements, and/or components, but not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the one or more embodiments of the invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the invention has been particularly shown and described with reference to one or more embodiments, it will be understood by those skilled in the art that various changes in form and detail may be made therein without departing from the spirit and scope of the invention.

What is claimed is:

1. An interposer comprising:

a substrate comprising a first side opposite a second side;

a first plurality of flexible pins protruding from the first side of the substrate, the first plurality of flexible pins for installing in a first plurality of pad connectors of a pinless socket;

a second plurality of flexible pins protruding from the second side of the substrate, the second plurality of flexible pins for installing in a second plurality of pad connectors of a pinless integrated circuit component; and a first presence pin specified from among the first plurality of flexible pins and set to ground opposite a second pin from among the second plurality of flexible pins not specified for an electrical connection, wherein the first presence pin is specified to align with a particular pad connector from among the first plurality of pad connectors comprising an input port of the pinless socket;

wherein the first plurality of flexible pins except the first presence pin are electrically connected to the second plurality of flexible pins through the substrate to provide a plurality of electrical contact points between the pinless socket and the pinless integrated circuit component.

2. The interposer of claim 1, further comprising:

a first guide pin specified from among the first plurality of flexible pins, wherein the first guide pin is positioned to align with a first guide space set within the pinless socket for guiding a positioning of the interposer during installation of the first plurality of flexible pins in the first plurality of pad connectors.

3. The interposer of claim 1, wherein the substrate is of a material of a thickness and strength to avoid bowing.

4. A system comprising:

a pinless socket comprising a first plurality of pad connectors;

a pinless integrated circuit component comprising a second plurality of pad connectors;

an interposer comprising a substrate comprising a first side opposite a second side;

the interposer comprising a first plurality of flexible pins protruding from the first side of the substrate, the first plurality of flexible pins for installing in the first plurality of pad connectors of the pinless socket;

the interposer comprising a second plurality of flexible pins protruding from the second side of the substrate, the second plurality of flexible pins for installing in the second plurality of pad connectors of the pinless integrated circuit component;

a first presence pin specified from among the first plurality of flexible pins and set to ground opposite a second pin from among the second plurality of flexible pins not specified for an electrical connection, wherein the first presence pin is specified to align with a particular pad connector from among the first plurality of pad connectors comprising an input port of the pinless socket, wherein the first plurality of flexible pins except the first presence pin are electrically connected to the second plurality of flexible pins through the substrate to provide a plurality of electrical contact points between the pinless socket and the pinless integrated circuit component, and wherein the first plurality of flexible pins are installed in the first plurality of pad connectors of the pinless socket;

a pull up resistor installed on the input port and operative to set a signal for a presence bit to a first logical bit if the interposer is properly installed; and an input/output controller for reading the signal from the input port;

wherein the input/output controller is operative to output a signal indicating a proper installation of the interposer if the presence bit is set to the first logical bit in the signal read from the input port; and wherein the input/output controller is operative to output a signal indicating installation of the interposer if the presence bit is set to a second logical bit in the signal read from the input port.

5. The system of claim 4, wherein:

the first plurality of flexible pins are installed in the first plurality of pad connectors of the pinless socket and locked down;

the second plurality of flexible pins are installed in the second plurality of pad connectors of the pinless integrated circuit component and locked down;

the first plurality of flexible pins are removable from the first plurality of pad connectors; and the second plurality of flexible pins are removable from the second plurality of pad connectors.

6. The system of claim 4, wherein the socket is a CPU socket on a CPU board.

7. The system of claim 4, wherein the integrated circuit component is a large-scale integration device.

* * * * *